US005366032A

United States Patent [19]

Kay

[11] Patent Number: 5,366,032

[45] Date of Patent: Nov. 22, 1994

[54] ROCK BIT

[76] Inventor: Mark A. Kay, P.O. Box 29325, Dallas, Tex. 75229

[21] Appl. No.: 74,774

[22] Filed: Jun. 9, 1993

[51] Int. Cl.[5] ..... E21B 10/38

[52] U.S. Cl. ..... 175/393; 175/394; 175/418

[58] Field of Search ..... 175/393, 394, 417, 418, 175/428, 426

[56] References Cited

U.S. PATENT DOCUMENTS

| | | | |
|---|---|---|---|
| 54,226 | 4/1866 | Smith . | |
| 1,307,525 | 6/1919 | Trebert . | |
| 1,703,390 | 2/1929 | Duffy . | |
| 1,734,469 | 11/1929 | Journeay . | |
| 1,734,672 | 11/1929 | Harralson . | |
| 2,215,494 | 9/1940 | Athy . | |
| 2,519,861 | 8/1950 | Turner . | |
| 2,728,558 | 12/1955 | Tengberg | 175/395 |
| 2,735,116 | 2/1956 | Mueller | 408/218 |
| 2,794,623 | 6/1957 | Stokes | 175/394 |
| 2,821,364 | 1/1958 | Godfrey . | |
| 3,145,789 | 8/1964 | Lawry . | |
| 3,339,649 | 9/1967 | Forssén | 175/426 X |
| 4,245,708 | 1/1981 | Cholet et al. | 175/339 X |
| 4,285,618 | 8/1981 | Shanley, Jr. | 407/54 |
| 4,515,227 | 5/1985 | Cerkovnik | 175/393 X |
| 4,765,416 | 8/1988 | Bjerking et al. | 175/393 X |
| 4,887,677 | 12/1989 | Warren et al. | 175/339 |
| 4,953,642 | 9/1990 | Skaggs | 175/393 |

FOREIGN PATENT DOCUMENTS

| | | | |
|---|---|---|---|
| 375221 | 5/1923 | Germany | 175/394 |
| 1002503 | 3/1983 | U.S.S.R. | 175/393 |

OTHER PUBLICATIONS

"Sandvik Coromant Catalog", 1969, pp. 12, 19, 26, 30.

*Primary Examiner*—Hoang C. Dang

*Attorney, Agent, or Firm*—Richards, Medlock & Andrews

[57] ABSTRACT

A rock bit is provided that comprises a generally cylindrical body with a leading end for boring in a rock formation and a trailing end for connection to a drill rod. The body has a generally cylindrical outside surface and comprises a plurality of parallel longitudinal grooves circumferentially spaced around the outside surface and extending from the leading end to the trailing end. The grooves have a depth that increases from the leading end to the trailing end such that the cross-sectional area of the grooves also increases towards the trailing end of the body of the bit. The body also comprises at least one channel machined in the outside surface of the body that extends between adjacent pairs of longitudinal grooves at an oblique angle to the grooves.

27 Claims, 2 Drawing Sheets

ROCK BIT

TECHNICAL FIELD OF THE INVENTION

This invention relates to a rock bit used in combination rotative, percussive boring of boreholes rock formations.

BACKGROUND OF THE INVENTION

In boring holes in rock formations, a common practice is to use a bit attached to a drill rod and simultaneously rotate and percuss the bit into the rock. The various design parameters for such a bit include a geometry of the bit body to insure the bit's stability in the borehole and a surface configuration of the bit that allows ready removal of the cuttings past the bit and out of the borehole. Prior bits have used geometries that include a larger head portion followed by a necked portion attached to the drill rod. These bits often have problems with stability in the hole.

A prior art bit that uses a generally cylindrical shaped bit body is shown in U.S. Pat. No. 4,953,642. While this geometry is desirable for its stability in the borehole, the configuration of the bit surface has a plurality of lateral grooves to pulverize the cuttings in the borehole which can contribute to binding of the bit in the borehole and especially to raising the temperature of the bit. When the temperature of the bit rises too much, there is an increased risk that the carbides on the leading end of the bit body will pop out of the holes that they are pressed into. Furthermore, many drilling operators prefer the cuttings not to be excessively pulverized.

Thus, a need exists for a bit with a stable geometry but also with a surface configuration that allows cuttings to be readily removed past the bit body and out of the borehole without excessive pulverization or hindrance of the cuttings by the outside surface of the bit body.

SUMMARY OF THE INVENTION

The present invention provides a rock bit adapted for rotative and percussive drilling of a borehole in a rock formation. The bit comprises a generally cylindrical body with a leading end, a trailing end, and a generally cylindrical outside surface. The leading end is suitable for boring against the rock formation, and the trailing end is suitable for attachment to a drill rod.

The body also has a plurality of circumferentially spaced and substantially parallel longitudinal grooves machined along the outside surface of the body. These grooves extend from the leading end of the body to the trailing end of the body. The longitudinal grooves have a depth that increases towards the trailing end. The cross-sectional area of the grooves is sized such that cuttings from the rock formation can readily pass from the leading end of the bit to the trailing end of the bit along the longitudinal grooves during operation of the bit.

The body also comprises at least one channel machined along the outside surface of the body at a depth not more than the depth of the longitudinal grooves and which extends between at least two of the plurality of longitudinal grooves at an oblique angle to the longitudinal grooves. It is preferred that there is one channel between each pair of adjacent longitudinal grooves and that the channels are longitudinally staggered in a spiraled arrangement about the outside surface of the body of the bit.

The bit of the present invention allows for improved removal of cuttings during operation of the bit. Furthermore, the arrangement of the grooves and channels contributes to reducing the heating of the bit during operation. The grooves of the present invention also help prevent the cuttings from falling back into the grooves and causing the bit to bind in the borehole.

DETAILED DESCRIPTION

Figure 1:
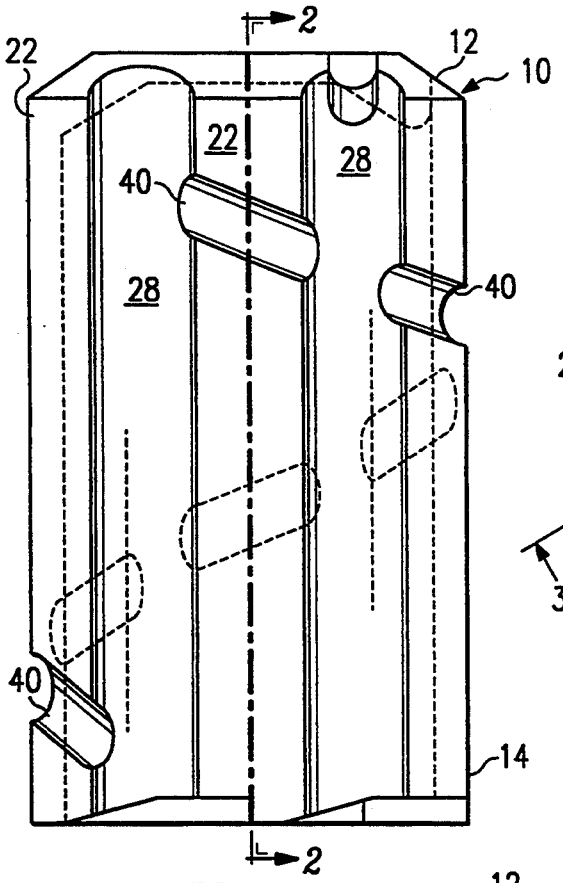
FIG. 1 is a side elevation of the preferred embodiment of the bit of the present invention.
Figure 2:
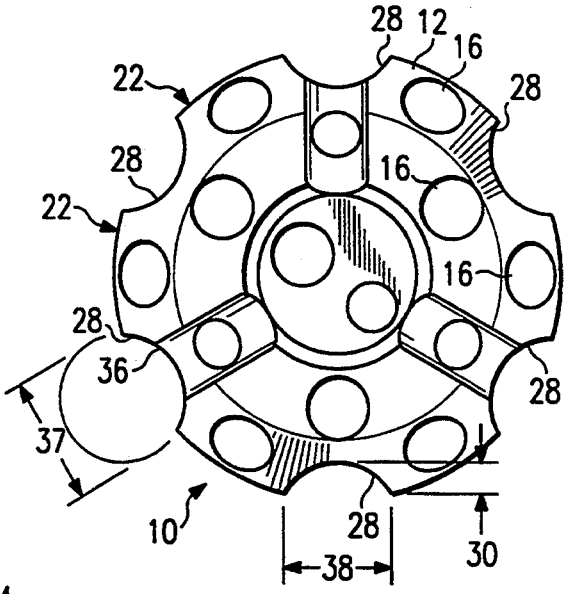
FIG. 2 is a top view of the bit showing the leading end of the bit.
Figure 3:
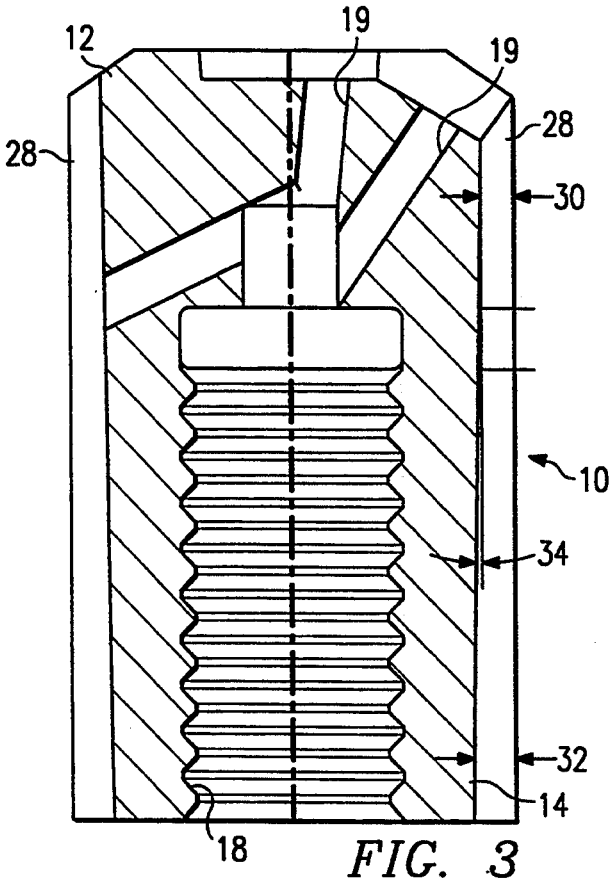
FIG. 3 is a cross section of the bit along line 2—2 of FIG. 1.

With reference to FIGS. 1–3 the preferred embodiment of rock bit 10 of the present invention is shown. Bit 10 has generally leading end 12 and trailing end 14. Leading end 12 has a plurality of hardened buttons 16 mounted therein and is suitable for percussive contact with the material to be bored. Trailing end 14 has hole 18 therein that is adapted to engagingly receive a drill rod. Bit 10 also defines passages 19 which run from hole 18 to the surface of leading end 12. The longitudinal direction of bit 10 is defined as running from leading end 12 to trailing end 14. Bit 10 has outside surface 22 which is interrupted by longitudinal grooves 28 machined therein. In operation, a flushing fluid, commonly air, is pumped down a hollow drill rod and into hole 18. The fluid then flows through passages 19 and onto the surface of leading end 12 to flush cuttings away from leading end 12 and towards the side of the bore to travel up and out the bore past bit 10. Longitudinal grooves 28 in sidewall 22 facilitate the travel of cuttings away from the leading end of the bit by providing an area for the cuttings to travel as opposed to the negligible space between outside surface 22 and the bore wall. Without longitudinal grooves 28, cuttings will not as readily flow past the bit and can cause the bit to bind in the bore.

The longitudinal grooves 28 have a further advantage that can be seen in FIG. 3. Grooves 28 are machined into sidewall 22 such that first depth 30 of grooves 28 at leading end 12 is shallower than second depth 32 at trailing end 14. By deepening longitudinal grooves 28 as they approach trailing end 14, the cross-section of the grooves also increases towards trailing end 14. It has been found that a deepening or enlargement of groove cross-section provides an appreciable improvement in the removal of cuttings over longitudinal grooves that have a constant depth from one end to the other. In the preferred embodiment, grooves 28 have slope 34 of about 1 degree, first depth 30 is about 0.26 inches and the length of grooves 28 is about 6 inches. Second depth is approximately 0.30 inches. A comparison between constant depth grooves and sloped grooves of about 1 degree has shown that the removal of cuttings is superior in the bits with sloped grooves.

The construction of grooves 28 can be seen in more detail in FIG. 2. The contour 36 of the grooves is an arcuate segment of a circle with a diameter 37 of about one inch. There are six grooves spaced 60° apart. The width 38 of grooves 28 is about 21/32 of an inch in the preferred embodiment. As the groove is machined towards trailing end 14, the arcuate segment becomes larger causing depth 30 and width 38 to enlarge.

Figure 4:
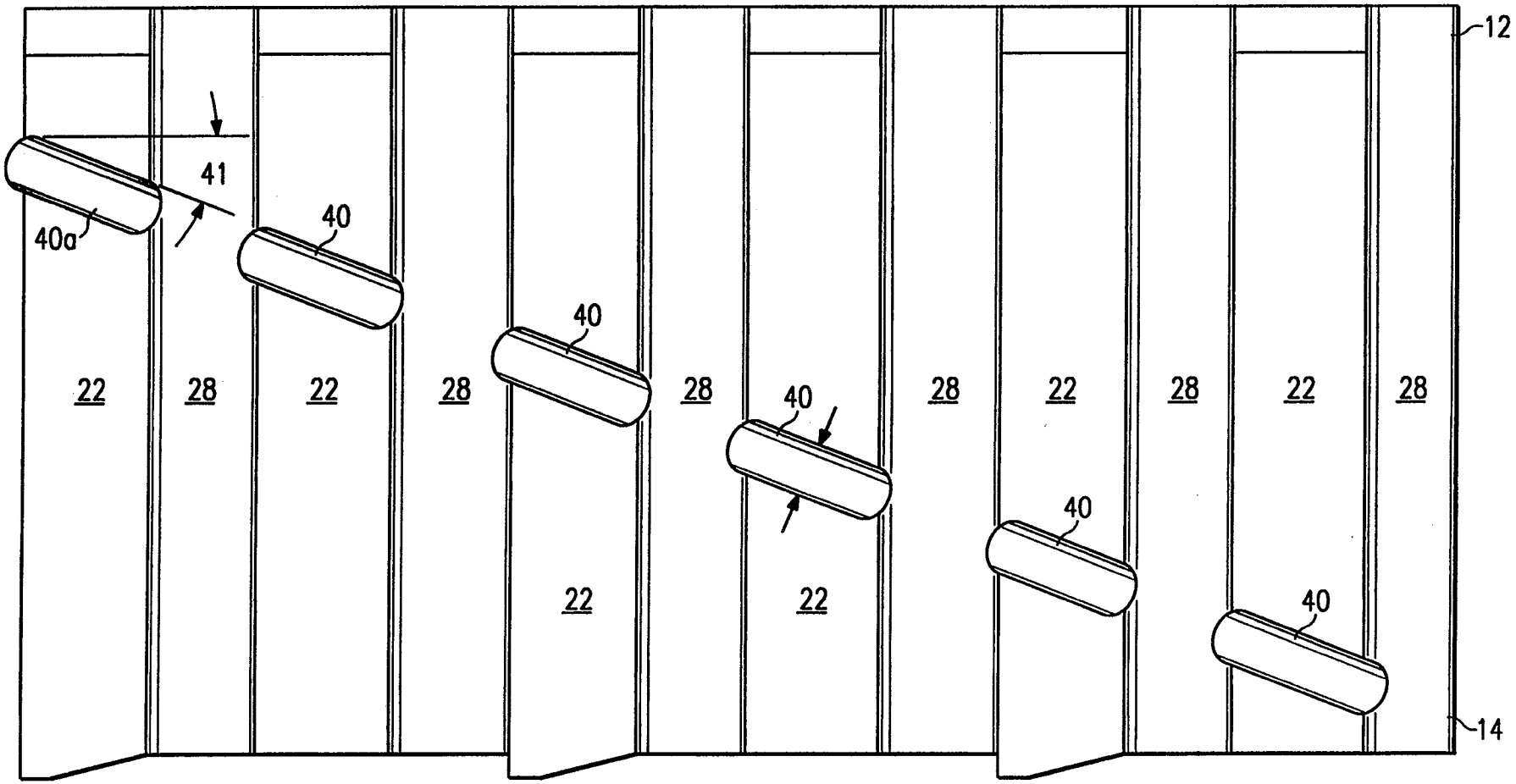
FIG. 4 is an expanded view of the outside surface of the bit showing the relationship of the grooves and channels.

FIG. 4 illustrates another feature of bit 10: slanted channels 40 are machined into sidewall 22 to create a spiral arrangement of channels 40 around bit There is one channel 40 between each pair of adjacent longitudinal grooves that is at an oblique angle 41 to grooves 28. First slanted channel 40*a* is towards leading end 12. Each successive channel is located closer to trailing end 14. In the preferred embodiment slanted channels 40 are oriented and located such that a line drawn from one channel to the next would create a spiral around bit 10. It is preferred that channels 40 have an angle of 22° with respect to a line perpendicular to the longitudinal axis. Or, in other words, the channels are slanted at about 68° with respect to the grooves themselves.

As bit 10 is rotated in the borehole, slanted channels further facilitate the removal of cuttings and flushing fluid along the bit. The slant of the channels means that as the bit rotates, flushing fluid forced through a channel and into a longitudinal groove provides an additional flushing force within the longitudinal groove. Without the slanted channels, the only flushing force in the longitudinal grooves is that received from the end of the grooves at the leading end of the bit. The slanted channels further help to equalize the flow of flushing fluid through the grooves so that one groove will be less likely to be clogged and cause the bit to bind in the borehole.

Furthermore, when the slanted channels 40 are in a spiral configuration, they contribute to stability of the bit in the borehole during rotative/percussive drilling.

Although the present invention has been described with respect to a preferred embodiment, various changes, substitutions and modifications of this invention may be suggested to one skilled in the art, and it is intended that the present invention encompass such changes, substitutions and modifications as fall within the scope of the appended claims.

I claim:

1. A rock bit adapted for rotative and percussive drilling of a borehole in a rock formation, comprising:

(a) a generally cylindrical body having a leading end, a trailing end, and a generally cylindrical outside surface, the leading end suitable for boring against the rock formation, the trailing end suitable for attachment to a drill rod, the body also having:

(b) a plurality of circumferentially spaced and substantially parallel longitudinal grooves machined along the outside surface of the body from the leading end of the body to the trailing end of the body, the longitudinal grooves having a depth that increases towards the trailling end and sized such that cuttings from the rock formation can readily pass from the leading end of the bit to the trailing end of the bit along the longitudinal grooves during operation of the bit;

(c) at least one channel machined into the outside surface of the body at a depth not more than the depth of the longitudinal grooves and extending between two of the plurality of longitudinal grooves at an oblique angle to the longitudinal grooves.

2. The rock bit of claim 1 wherein the longitudinal grooves have a bottom contour that is concave radially inwardly.

3. The rock bit of claim 1 wherein the depth of the longitudinal grooves increases towards the trailing end at a slope of at least about one degree.

4. The rock bit of claim 1 wherein the plurality of longitudinal grooves comprises six longitudinal grooves spaced equally apart around the outside surface of the body.

5. The rock bit of claim 1 wherein the longitudinal grooves have a width that increases from the leading end to the trailing end of the bit.

6. The rock bit of claim 1 wherein the at least one channel comprises one channel extending obliquely between each pair of adjacent longitudinal grooves.

7. The rock bit of claim 6 wherein the channels are longitudinally staggered from each other.

8. The rock bit of claim 7 wherein the channels are successively longitudinally staggered in a spiral arrangement about the outside surface of the bit.

9. The rock bit of claim 1 wherein the channels are angled with respect to the longitudinal grooves from about 45 to about 75 degrees.

10. The rock bit of claim 1 wherein the channels have a bottom contour that is concave radially inwardly.

11. A rock bit adapted for rotative and percussive drilling of a borehole in a rock formation, comprising:

(a) a generally cylindrical body having (b) a leading end suitable for boring against the rock formation;

(c) a trailing end suitable for attachment to a drill rod;

(d) a generally cylindrical outside surface suitable for rotating within a close tolerance borehole in a rock formation;

(e) the body defining a plurality of circumferentially spaced and substantially parallel longitudinal grooves machined along the outside surface of the body from the leading end of the body to the trailing end of the body, the longitudinal grooves having a depth that increases towards the trailing end at a slope of at least about one degree and having a cross-section sized such that cuttings from the rock formation can readily pass from the leading end of the bit to the trailing end of the bit along the longitudinal grooves during operation of the bit in the borehole; and (f) further comprising at least one channel machined into the outside surface of the body at a depth not more than the depth of the longitudinal grooves and extending between two of the plurality of longitudinal grooves at an oblique angle to the longitudinal grooves.

12. The rock bit of claim 11 wherein the longitudinal grooves have a bottom contour that is concave radially inwardly.

13. The rock bit of claim 11 wherein the plurality of longitudinal grooves comprises six longitudinal grooves spaced equally apart around the outside surface of the body.

14. The rock bit of claim 11 wherein the longitudinal grooves have a width that increases from the leading end to the trailing end of the bit.

15. The rock bit of claim 11 wherein the at least one channel comprises one channel extending obliquely between each pair of adjacent longitudinal grooves.

16. The rock bit of claim 15 wherein the channels are successively longitudinally staggered in a spiral arrangement about the outside surface of the bit.

17. The rock bit of claim 15 wherein the channels are angled with respect to the longitudinal grooves from about 45 to about 75 degrees.

18. The rock bit of claim 11 wherein the depth of the longitudinal grooves increases towards the trailing end at a slope between about one degree and about four degrees.

19. A rock bit adapted for rotative and percussive drilling of a borehole in a rock formation, comprising:

(a) a generally cylindrical body having a leading end, a trailing end, and a generally cylindrical outside surface, the leading end suitable for boring against the rock formation, the trailing end suitable for attachment to a drill rod, the body also having:

(b) a plurality of circumferentially spaced and substantially parallel longitudinal grooves machined along the outside surface of the body from the leading end of the body to the trailing end of the body, the longitudinal grooves having a cross-section dimensioned large enough such that cuttings from the rock formation can readily pass from the leading end of the bit to the trailing end of the bit along the longitudinal grooves when the bit is in operation in a borehole, the depth of the longitudinal grooves increasing toward the trailing end at a slope of at least about one degree;

(c) at least one channel machined into the outside surface of the body at a depth not more than the depth of the longitudinal grooves and extending between two of the plurality of longitudinal grooves at an oblique angle to the longitudinal grooves.

20. The rock bit of claim 19 wherein the area of the cross-section of the longitudinal grooves increases from the leading end of the bit towards the trailing end of the bit.

21. The rock bit of claim 19 wherein the plurality of longitudinal grooves comprises six longitudinal grooves spaced equally apart around the outside surface of the body.

22. The rock bit of claim 19 wherein the longitudinal grooves have a width that increases from the leading end to the trailing end of the bit.

23. The rock bit of claim 19 wherein the at lease one channel comprises one channel extending obliquely between each pair of adjacent longitudinal grooves.

24. The rock bit of claim 23 wherein the channels are longitudinally staggered from each other.

25. The rock bit of claim 24 wherein the channels are successively longitudinally staggered in a spiral arrangement about the outside surface of the bit.

26. The rock bit of claim 19 wherein the channels are angled with respect to the longitudinal grooves from about 45 to about 75 degrees.

27. The rock bit of claim 19 wherein the longitudinal grooves have a bottom contour that is concave radially inwardly.

* * * * *